US011229937B2

(12) United States Patent
Pettie et al.

(10) Patent No.: US 11,229,937 B2
(45) Date of Patent: Jan. 25, 2022

(54) METHOD AND MACHINE FOR BENDING METAL INCLUDING ADJUSTABLE DIE

(71) Applicant: Accurpress America Inc., Rapid City, SD (US)

(72) Inventors: Scott Pettie, Rapid City, SD (US); Dragisa Djuric, Rapid City, SD (US)

(73) Assignee: ACCURPRESS AMERICA INC., Rapid City, SD (US)

( * ) Notice: Subject to any disclaimer, the term of this patent is extended or adjusted under 35 U.S.C. 154(b) by 114 days.

(21) Appl. No.: 16/180,983

(22) Filed: Nov. 5, 2018

(65) Prior Publication Data

US 2019/0134688 A1 May 9, 2019

Related U.S. Application Data

(60) Provisional application No. 62/581,553, filed on Nov. 3, 2017.

(51) Int. Cl.
*B21D 5/02* (2006.01)

(52) U.S. Cl.
CPC ..... *B21D 5/0209* (2013.01)

(58) Field of Classification Search
CPC .. B21D 5/0209; B21D 5/0227; B21D 5/0236; B21D 5/0254; B21D 37/02
See application file for complete search history.

(56) References Cited

U.S. PATENT DOCUMENTS

| | | | | |
|---|---|---|---|---|
| 4,367,644 A | | 1/1983 | Kramer et al. | |
| 4,653,307 A | * | 3/1987 | Zbornik | B21D 5/0209 72/389.4 |
| 2018/0009020 A1 | * | 1/2018 | Grewe | B21D 37/02 |

FOREIGN PATENT DOCUMENTS

| | | | | |
|---|---|---|---|---|
| CN | 104874682 A | | 9/2015 | |
| CN | 106807838 A | * | 6/2017 | |
| EP | 2674231 A1 | | 12/2013 | |
| EP | 2674231 B1 | * | 9/2014 | B21D 5/0209 |
| EP | 2674231 B1 | | 9/2014 | |
| JP | H0716654 A | | 1/1995 | |

(Continued)

OTHER PUBLICATIONS

English translate (EP2674231B1), retrieved date Jul. 7, 2020.*

(Continued)

*Primary Examiner* — Jimmy T Nguyen
*Assistant Examiner* — Mohammed S. Alawadi
(74) *Attorney, Agent, or Firm* — Gordon Rees Scully Mansukhani, LLP

(57) ABSTRACT

A press brake for bending a workpiece including a movable ram and a support beam. A punch is connected to the ram, and a die is connected to the support beam. The punch and the die are separated by a gap. The ram is configured to be driven towards the support beam to thereby close the gap between the punch and the die and deform the workpiece. The die includes a pair of die members extending in a longitudinal direction separated by a recess having a width in a lateral direction perpendicular to the longitudinal direction. The width of the recess is adjustable by moving the die members, which are releasably engaged with the support beam. The die members move horizontally to disengage from the support beam to thereby allow for lateral movement of the die members to adjust the width of the recess.

20 Claims, 13 Drawing Sheets

(56) References Cited

FOREIGN PATENT DOCUMENTS

| | | |
|---|---|---|
| KR | 20100065750 A | 6/2010 |
| KR | 10-1036007 | 5/2011 |

OTHER PUBLICATIONS

English translate (CN106807838A), retrieved date Aug. 11, 2021.*
International Search Report and Written Opinion dated Feb. 14, 2019 issued in related International Application No. PCT/US2018/059257 filed Nov. 5, 2018.

* cited by examiner

METHOD AND MACHINE FOR BENDING METAL INCLUDING ADJUSTABLE DIE

CROSS REFERENCE TO RELATED APPLICATIONS

This application claims priority to and the benefit of U.S. Provisional Patent Application No. 62/581,553 filed on Nov. 3, 2017. The foregoing provisional application is incorporated by reference herein in its entirety.

BACKGROUND

The application relates generally to press brakes and, in particular, a press brake that includes a structure and mechanism for adjusting the width of a die.

A press brake machine or device is used as a tool to make precise bends in metal parts. Generally, a sheet of metal is placed within the machine and positioned precisely using a gauge. A punch, which often has the shape of a "V", is placed against the metal sheet at the point where a bend is required. A punch is pressed into the metal sheet, which in turn is pressed into the die causing the sheet to bend. Frequently, the press brake machine is configured so that die and the punch are long enough to contact the entire length or width of the sheet.

A press brake machine may be configured so that a forming die mounted on a bed may be "U" or "V" shaped. The die may include a pair of dies or half dies, for example. The distance between the dies may be adjusted so that the bearing areas for the metal part or work piece being formed can be adjusted according to the forming requirements for the work piece.

BRIEF DESCRIPTION OF THE DRAWINGS

Features, aspects, and advantages of the present invention will become apparent from the following description, appended claims, and the accompanying exemplary embodiments shown in the drawings, which are briefly described below.

DESCRIPTION

Various features of the present invention will be described with reference to the drawings. Like numbers are used throughout the drawings to refer to the same or similar parts and in each of the embodiments of the invention hereafter described.

Figure 1:
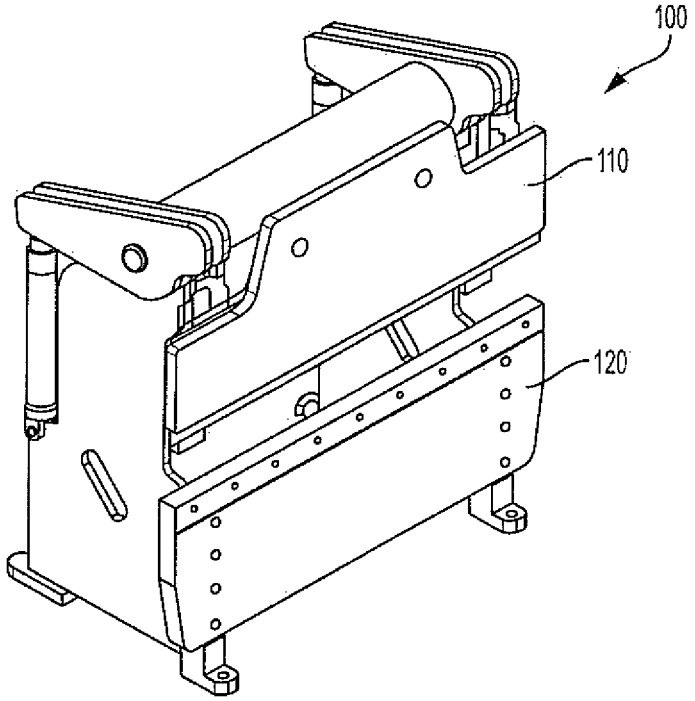
FIG. 1 is a front and right side perspective view of a press brake machine.
Figure 2:
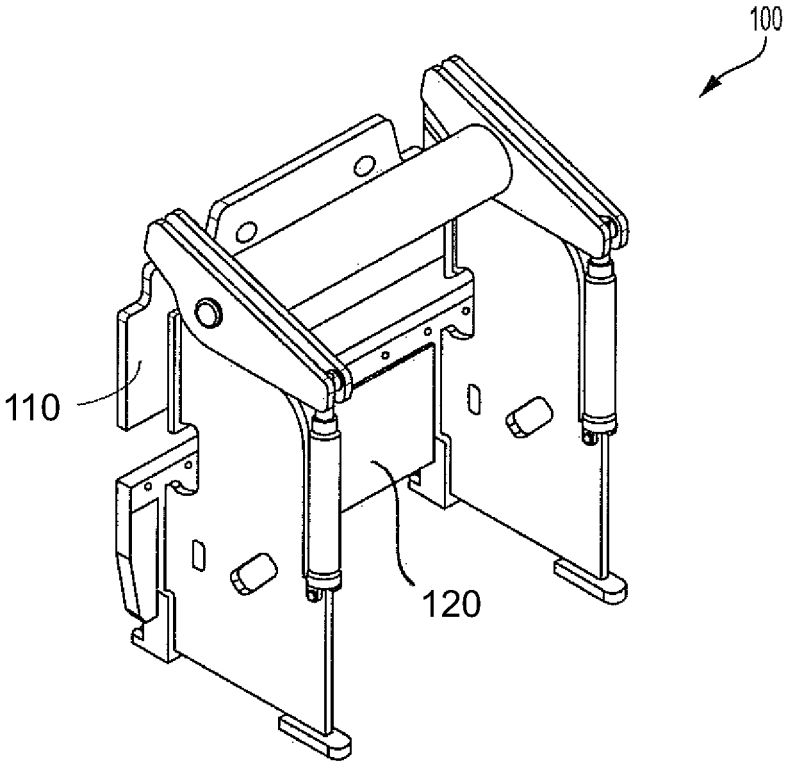
FIG. 2 is a left and rear perspective view of the press brake machine of FIG. 1.

The press brakes disclosed herein are used to bend or otherwise deform sheet-like work pieces, such as sheet metal work pieces. As shown in FIGS. 1 and 2, a press brake 100 has an upper beam 110 and a lower beam 120, at least one of which is movable toward and away from the other. Preferably, the upper beam is movable vertically while the lower beam is fixed in a stationary position. As an example, a male forming punch 112 and a female forming die 126 may be mounted respectively on the upper and lower beams of a press brake.

The punch has a downwardly-oriented, work piece-deforming surface (or "tip") 113. The configuration of this surface is dictated by the shape into which it is desired to deform a work piece 300. The die has a recess, bounded by one or more work piece-deforming surfaces, that is aligned with the tip of the punch. The configuration of this recess corresponds to the configuration of the punch's tip. Thus, when the beams are brought together, a work piece between them is pressed by the punch into the die to give the work piece a desired deformation (e.g., a desired bend).

Figure 10:
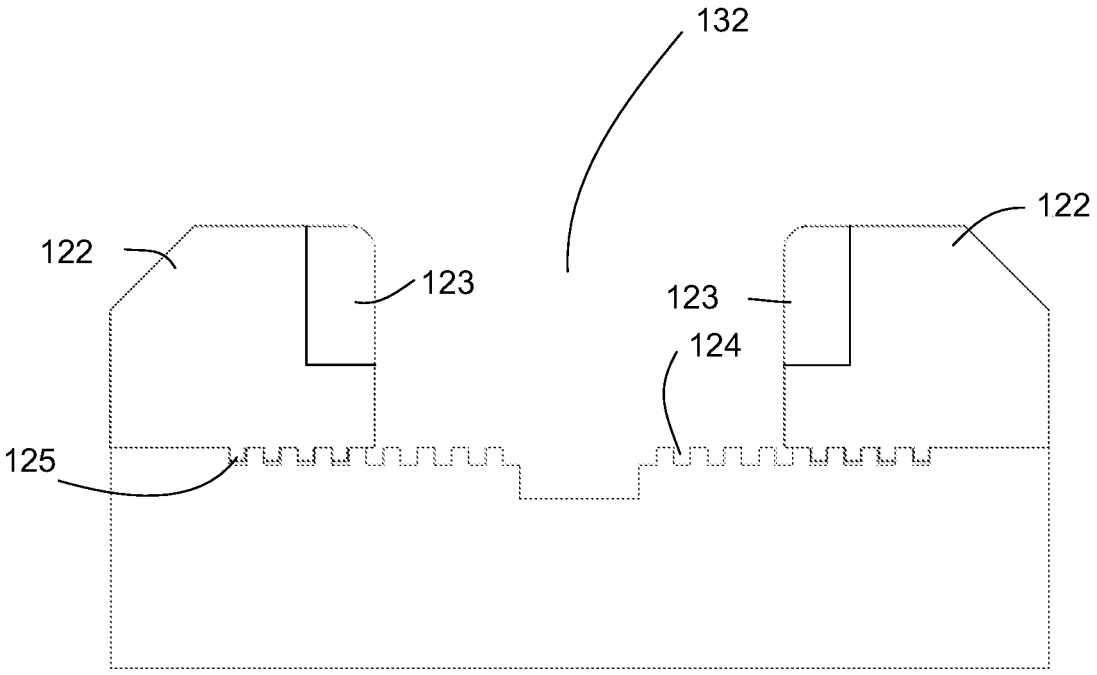
FIG. 10 is an end view showing an exemplary movable die in a locked position.

The lower beam or bed 120 may include a base plate 121 that supports a movable upright or riser 122. The upright 122 may carry an insert 123 positioned to contact the work piece during the bending operation. The upright 122 and insert 123 together form a die member 126 that may be adjustable to meet the requirements of the bending operation. As shown in FIG. 10, for example, the top surface of the base plate 121 may be a saw toothed or grooved surface 124 for engaging the bottom surface of the movable die. The bottom surface of the upright 122 may be a corresponding saw toothed or grooved surface 125 for interlocking and engaging the top surface 124 base plate 121. As shown in the figures, the press brake includes a pair of die members 126 (that together form a die) and a corresponding punch 112 that moves downwardly between the die members 126 to bend the work piece 300. The relative separation between the die members 126 can be adjusted when the uprights 122 are unlocked from the base plate 121.

Figure 11:
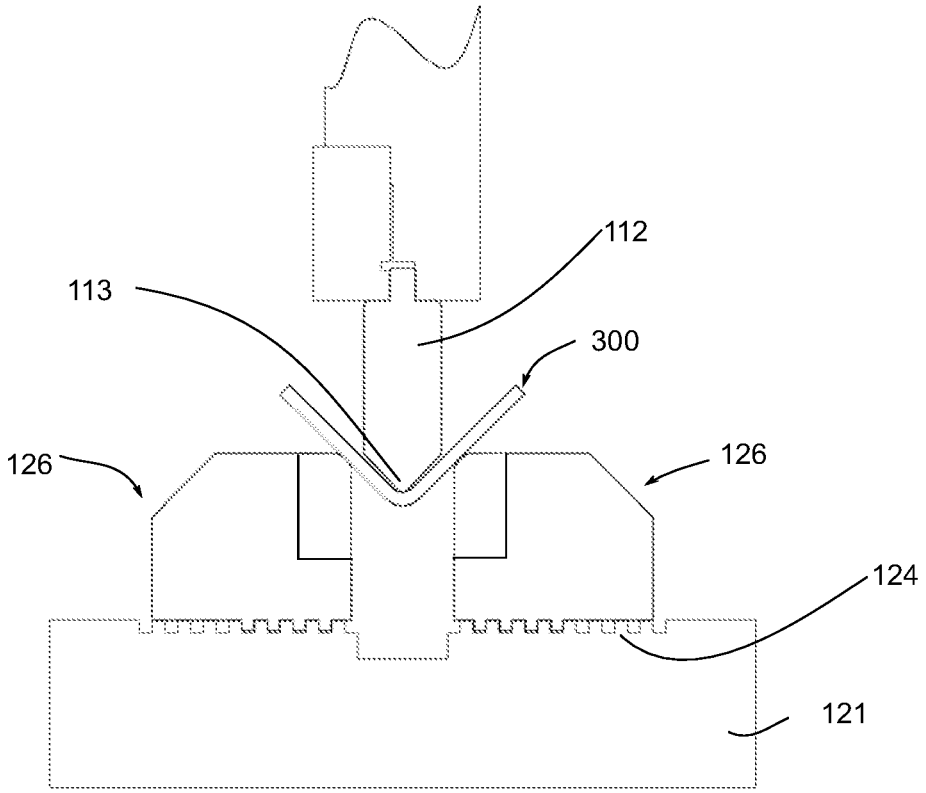
FIG. 11 is an end view showing the movable die of FIG. 10 including the press brake ram and punch and work piece being formed.

The locking mechanism for the uprights is accomplished through engaged or mating rows of projecting members (e.g., teeth shaped projections) located on facing parts. As shown in FIGS. 10 and 11, the mating teeth may project vertically and are located on horizontally oriented surfaces.

Figure 9:
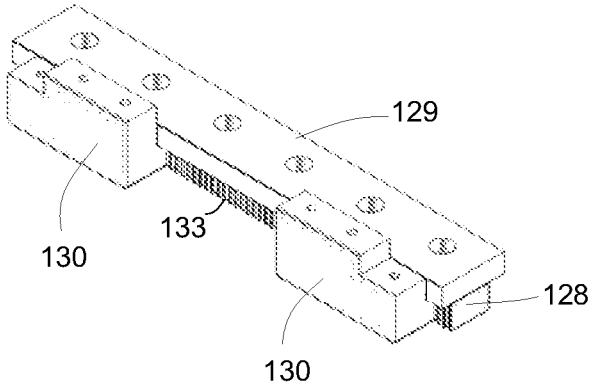
FIG. 9 is a view of the locking member and locking rack of FIG. 8 shown in the engaged position.
Figure 8:
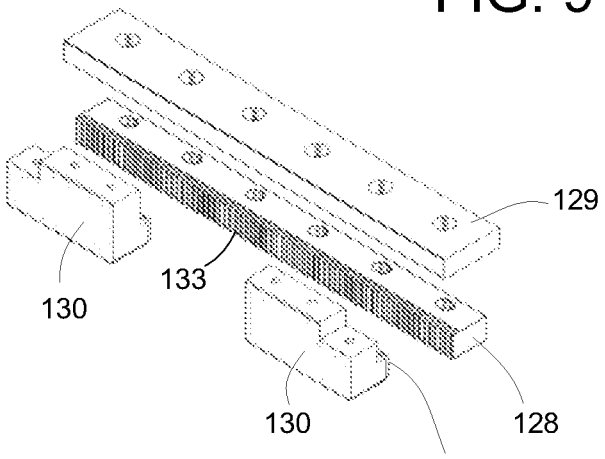
FIG. 8 is an exploded view of a locking member and a locking rack shown in FIG. 7.
Figure 13:
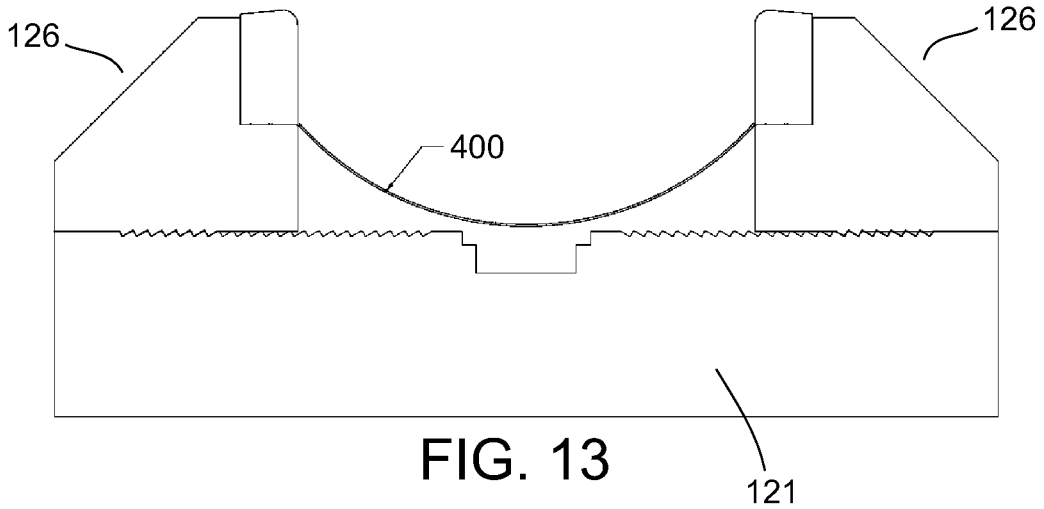
FIG. 13 is an end view showing an exemplary movable die in a locked position including a cover for protecting the grooved mating surfaces of the base plate from mill scale.
Figure 14:
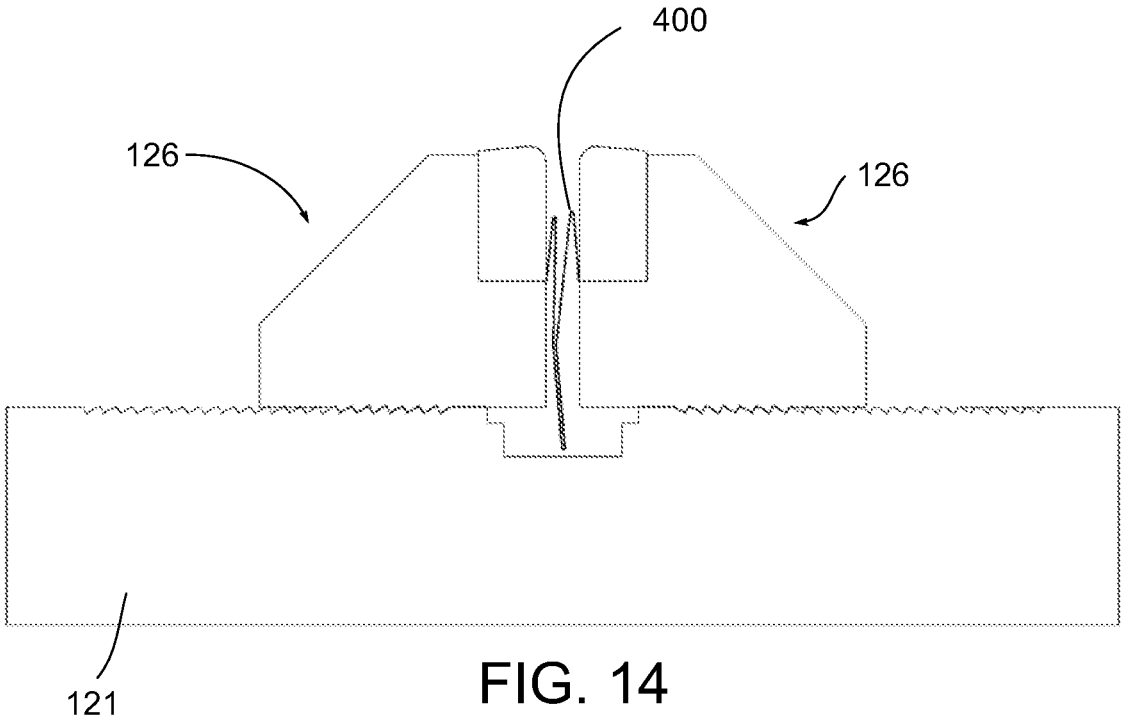
FIG. 14 is an end view showing the exemplary movable die of FIG. 13 with the dies in a narrow width position and the flexible cover compressed.

Alternatively, as shown in FIGS. 8 and 9, the mating teeth may project horizontally and may be located on vertically oriented surfaces. As a result of the vertically orientation of the toothed surfaces, mill scale will not collect in or on the engaging surfaces. Thus, as described below, according to a disclosed embodiment, there is no need for a protective cover 400 (such as shown in FIGS. 13 and 14) and the space between the uprights or risers of the die can be used for other purposes such as, for example, material handling.

Figure 3:
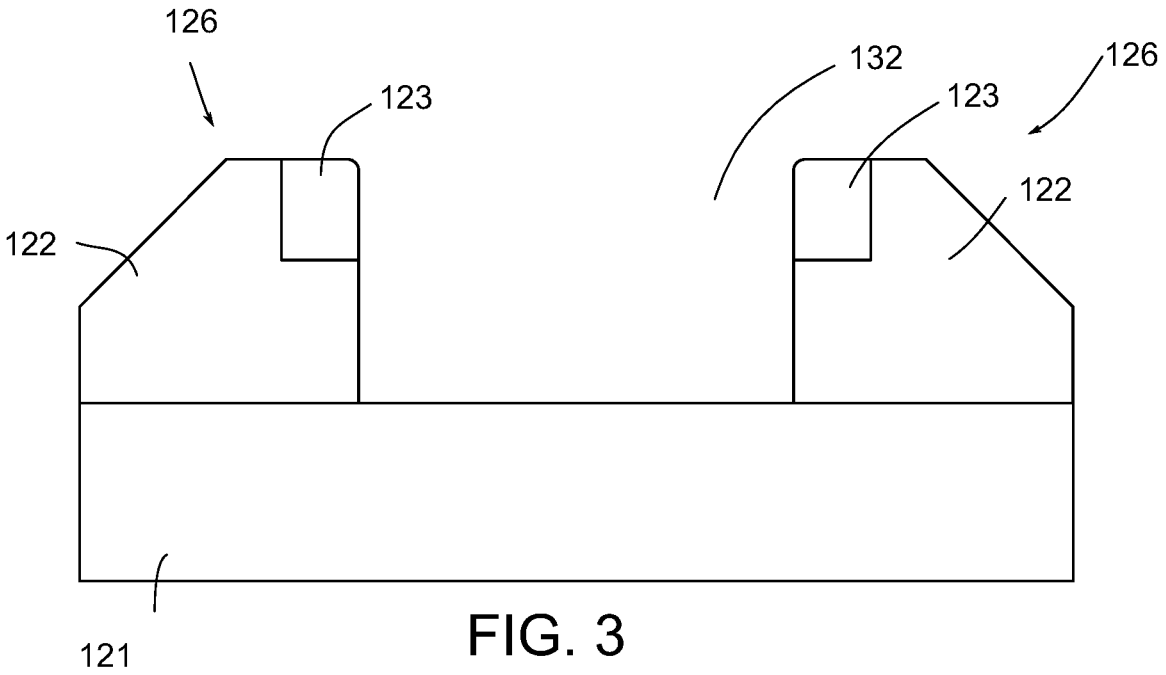
FIG. 3 is an end view showing the movable die and base.
Figure 4:
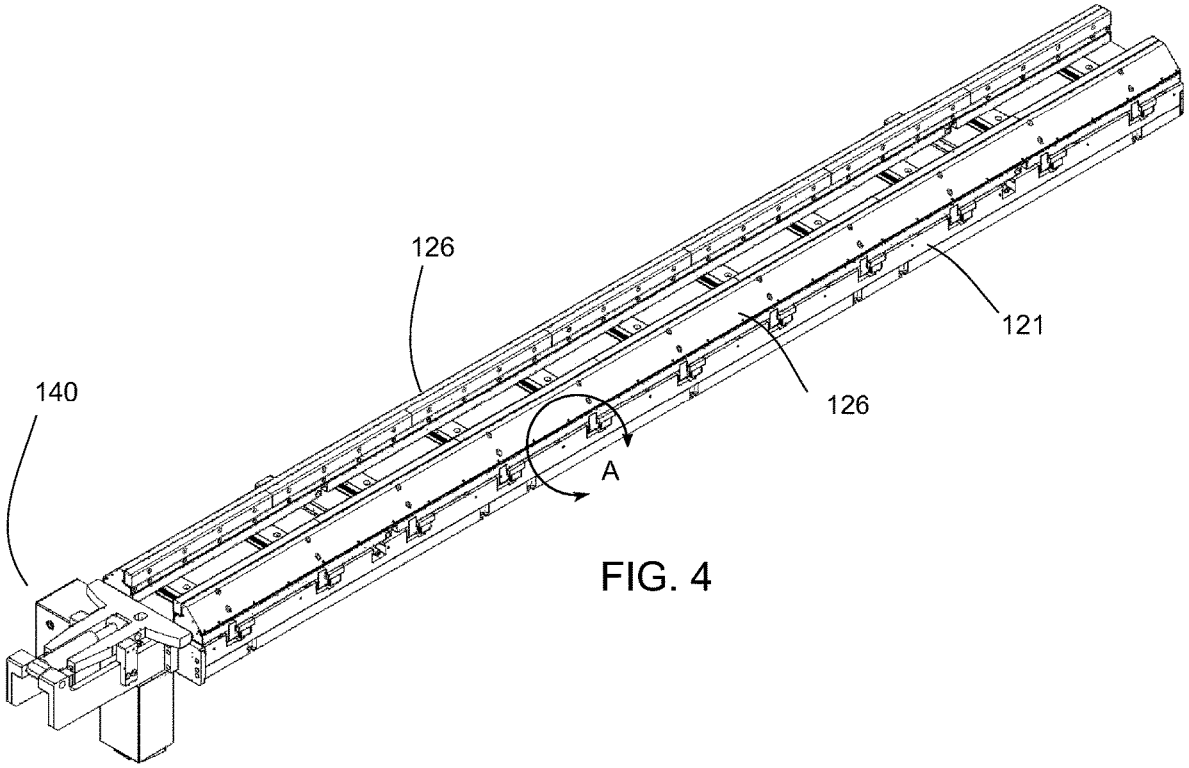
FIG. 4 is a right, top and front perspective view of a base plate and movable die for a press brake machine.

As shown in FIG. 3, each of the riser 122 and the base plate 121, may not include vertically projecting toothed surfaces. Alternatively, each riser 122 may be connected to a locking member (e.g., a t-slot nut member) 130 that includes a vertically oriented toothed or notched surface 131. The base 120 may include a locking rack 128 with a corresponding vertically oriented toothed or notched surface 133 that engages with the toothed surface 131 on the locking member 130. The toothed surfaces 131, 133 may each be characterized as a series of vertically extending grooves and protrusions. Each surface 131, 133 may include at least one of a protrusion and a groove in order to provide for a locking connection that prevents lateral movement of the die members. As shown in FIG. 4, the longitudinal length of the die may include a plurality of corresponding locking members and locking racks.

Figure 5:
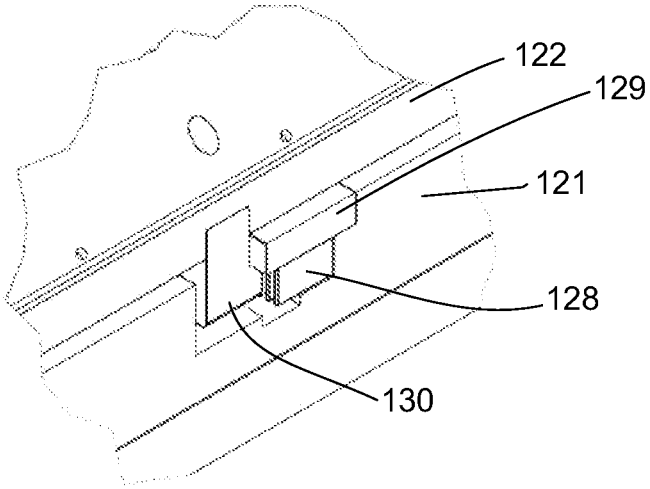
FIG. 5 is a close up view of the area encircled and identified by the letter A in FIG. 4 showing the locking mechanism for the movable die of FIG. 4.
Figure 6:
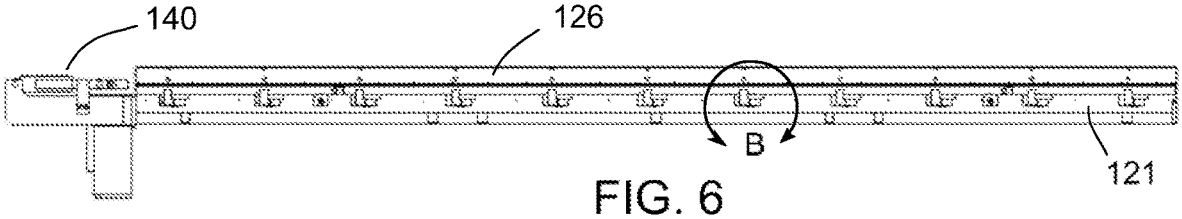
FIG. 6 is a right side view of a portion of the base plate and movable die shown in FIG. 4.

The press brake machine includes a locking and unlocking mechanism for locking and unlocking the die and the base plate. The locking mechanism includes a plurality of locking members (e.g., t-nut member) 130 that engage both the base plate and the dies. See, for example, FIGS. 5 and 7 which show the locking members 130 engaged with a locking rack 128 connected to the base plate 121. The position of the locking member 130 and movable upright or riser 122 may be changed using a hydraulic actuator 140 (see FIG. 3).

Figure 7:
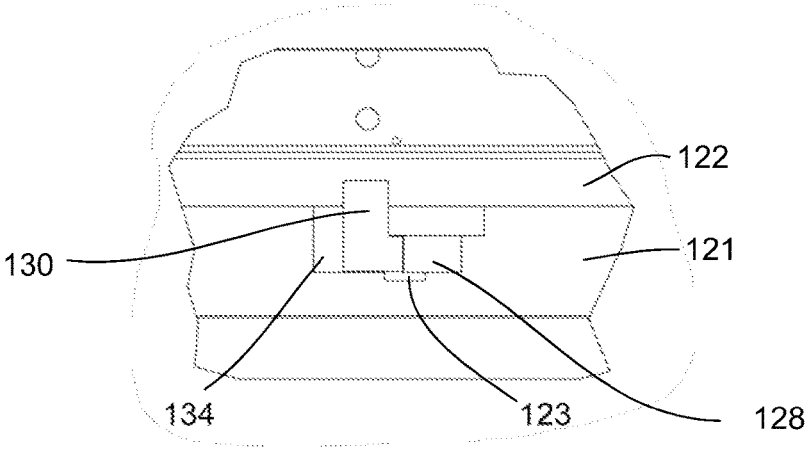
FIG. 7 is a close up view of the area encircled and identified by the letter B in FIG. 6 showing the locking mechanism for the movable die of FIG. 4.

As shown in FIG. 7, the disclosed locking mechanism may include areas for collecting the mill scale that results from the forming operation. For example, a first collection area 134 may be located behind the locking member 130. Further by way of example, the base plate may include a groove 123 that serves as a second collection area for falling mill scale. Thus, the disclosed arrangement provides for the mill scale to be easily collected and removed without interfering with the locking engagement of the risers and base plate.

Movement of the actuator 140 causes a corresponding longitudinal movement (i.e., parallel to the length of the die members 126) of the movable uprights 122 and the locking members 130, which are connected to the uprights 122. As shown in FIGS. 8 and 9, the toothed surface 131 of the locking member 130 engages the teeth 133 of the locking rack 128, which is fixed to the base plate 121. The base plate 121 may include an additional laterally extending mounting part 129 for securing the locking rack 128 to the base plate 121. For example, the locking rack 128 may be secured to the base plate using a laterally extending securing member or bar 129. The locking member 130 (and the attached risers 122) may move closer or further apart when not engaged in order to adjust the width of the die. FIGS. 4, 5, 6 and 7 show the locking members 130 and the dies 126 in the locked position. In the unlocked position, there is a horizontal separation between the locking member 130 and the locking rack 128. The movable locking members 130 may be integrally connected and driven and pulled by the actuator 140 shown in FIGS. 3 and 15, or may be connected via a linear rail, or any other suitable means. A driving mechanism, for example a motor driven lead screw that engages corresponding gears or screws, may be used to drive the lateral position of the die members 126 and adjust the width of the die.

While unlocked, the lateral position of the die members 126 may be adjusted using a suitable actuator (e.g., a hydraulic actuator, a motor driving a rotating shaft connected to a lead screw, or a rack and pinion and/or including an optional gear box and/or a linkage) or other appropriate mechanism. As a result, the size of the recess 132 formed between the die members 126 may be increased or decreased while the uprights 122 are unlocked.

Although not shown in FIG. 3, the actuator may be directly connected to the risers or upright members 122. The upright members 122 may be engaged to a longitudinal push/pull member in a manner that also permits lateral movement of the upright members 122 (e.g., a sliding hook and groove type connection).

Figure 16:
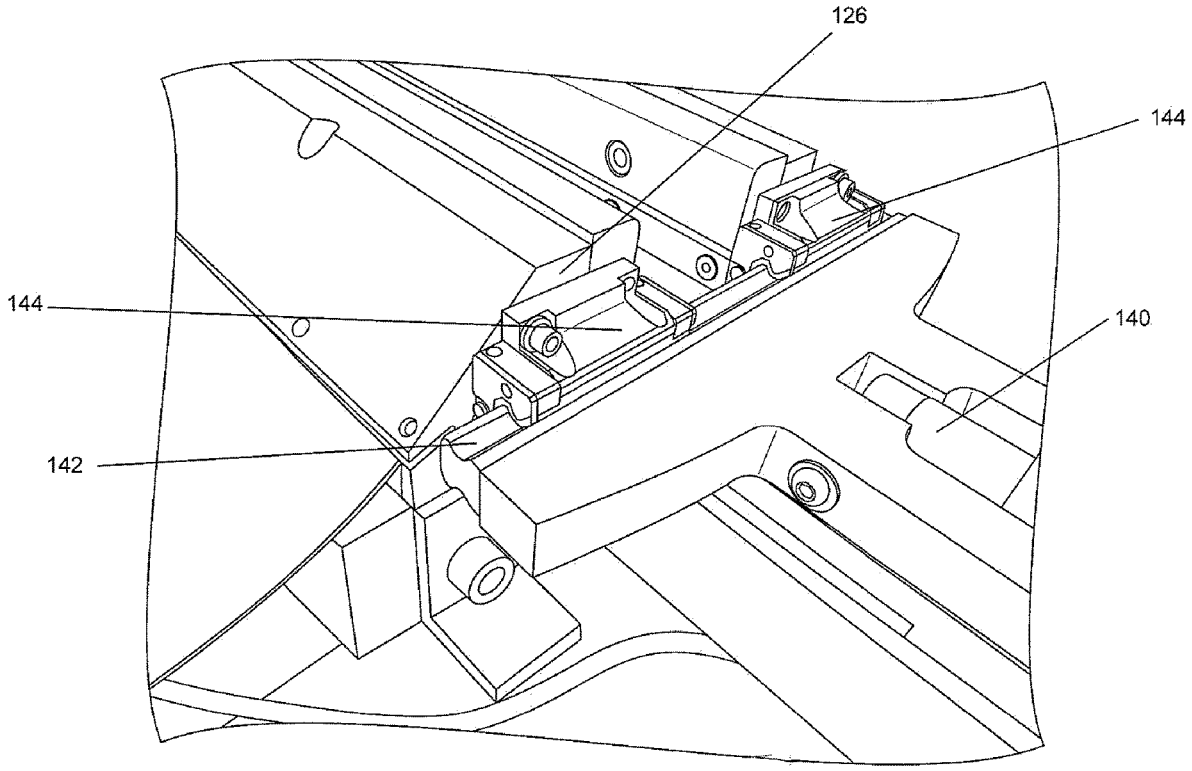
FIG. 16 is a left, top and front perspective view of a hydraulic actuator and linear rail for adjusting the position of the die.

For example, as shown in FIG. 16, the die members 126 may be driven longitudinally by an actuator 140 (e.g., a hydraulic piston cylinder actuator). The die members 126 may be connected to a linear rail 142 via connecting blocks 144 to allow for lateral movement of the die members and adjustment of the width of the recess, as shown in FIG. 14. The rail 142 and connecting blocks 144 move longitudinally with the die members when the actuator 140 is activated to disengage the upright or riser 122 (e.g., the t-nut member) from the base plate 121 (e.g., the locking rack).

The inserts 123 may be formed from strength hardened material in order to provide extra heavy load capacities and longer tool life. The inserts 123 can be replaced when needed, preserving the entire tool unit from tool wear. The press brake described herein eliminates the time, energy and storage space required in using and changing large bottom tools. The dies 126 can be adjusted eliminating the need to undertake a complete tool change out. The press brake provides all required sizes of "V" openings (i.e., Vee target, or die V opening) needed in one tool unit. The size of the recess can be as small as 0.5 inches, for example making it a suitable die holder for all standard bottom tools. In addition, the dies may be separated to provide adequate clearance to produce 90 degree bends. For example, larger profiles may be provided allowing for openings beyond 14 in.

The base can either be non crowning (a solid piece of steel) or crowning which is built into the middle cavity of the base. The above described inventive concept may include such an integrated crowning in the base.

The disclosed locking mechanism for the variable die is an improvement over other locking mechanisms. As shown in FIG. 11, a channel lock die concept may include a base and risers. The risers rest on top of the base and are adjusted in and out to reduce or increase the size of the opening between them. A workpiece, (e.g., sheet metal) is laid over the opening between the risers and is then pushed down into the opening by the punch mounted in the ram of the press brake to the desired angle as shown in FIG. 11, for example.

Figure 12:
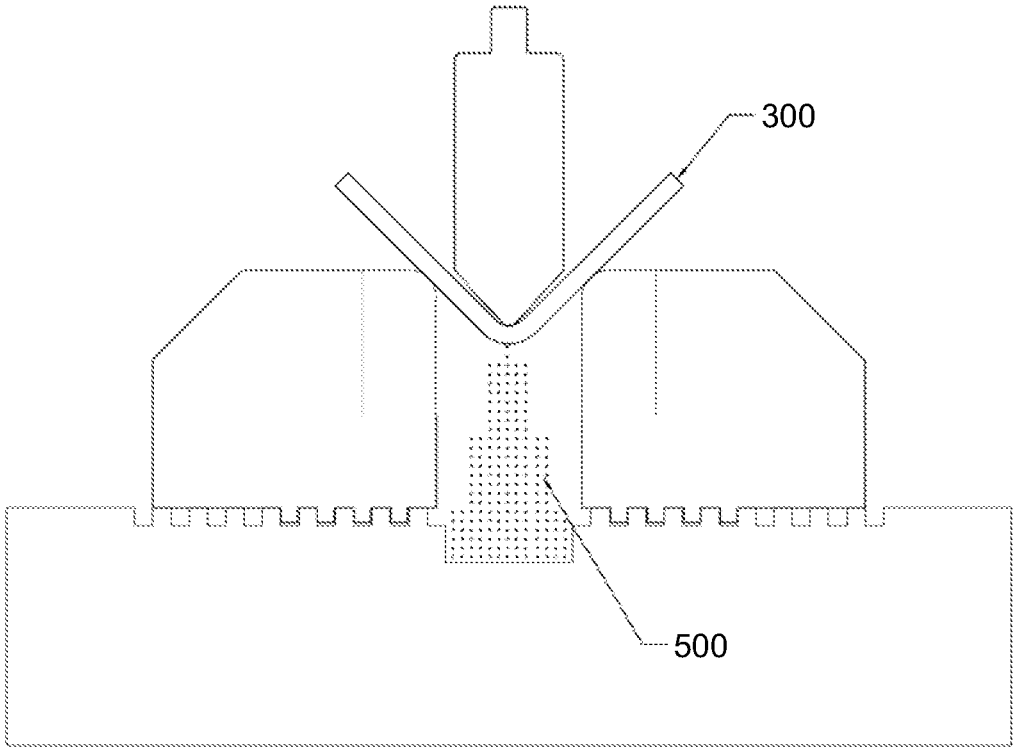
FIG. 12 is an end view showing the movable die of FIG. 10 including the press brake ram and punch and work piece being formed including a pictorial representation of mill scale falling from the work piece.

FIG. 12 shows a work piece 300 being formed, the outer shell of the work piece 300 (known as mill scale) may flake off in the area close to the bend line and fall into the center cavity between the risers. This mill scale 500 is required to be cleaned out of the teeth before the risers can be moved to a new position. This cleaning operation can be time consuming and cumbersome to accomplish. One solution for controlling the mill scale is to drape a protective cover 400 between the two risers such as shown in FIG. 13. For example, a plastic (e.g., urethane) cover may be used. This cover 400 collects the mill scale 500 as it falls off the work piece and keeps the teeth on the top face of the riser free from debris.

Figure 15:
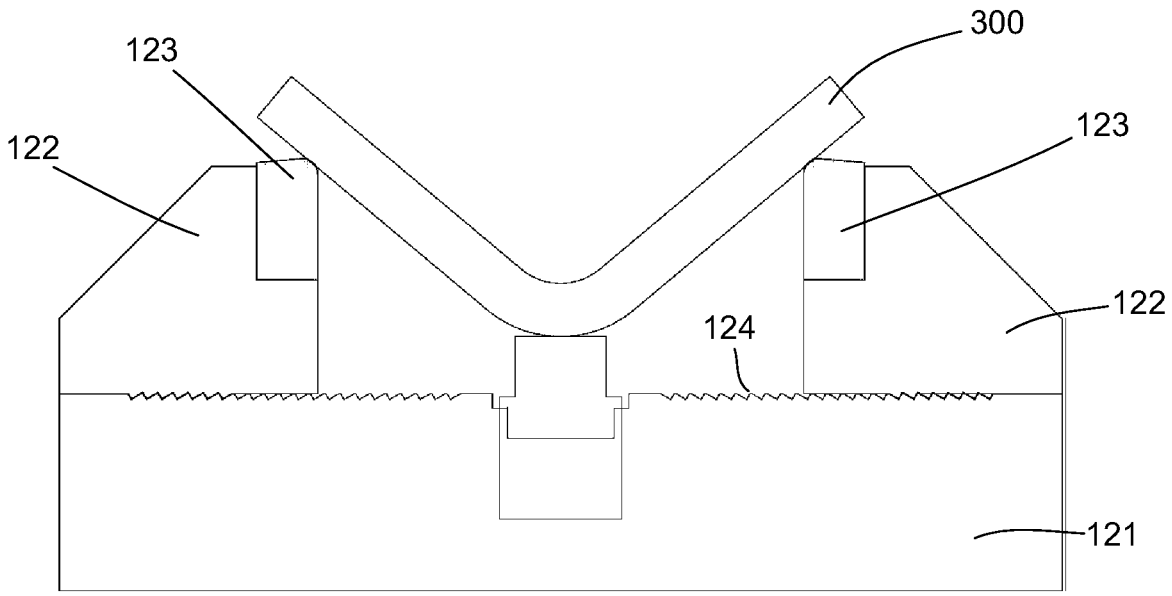
FIG. 15 is an end view showing an exemplary movable die such as shown in FIG. 3 with the movable die in a locked position including a work piece and a material handling device (e.g., a pop up roller) for assisting in the movement of the formed work piece.

The protective cover material (e.g., urethane) needs to be thin and flexible so it can conform to the small space between the two risers when they are closed into their smallest setting. For example, FIG. 14 shows the cover 400 compressed between the die members 126. In a fabricating shop environment this thin and flexible cover is damaged frequently and needs to be replaced often. Another disadvantage of having to use such a protective cover being draped between the two risers is it rules out the possibility of incorporating material handling features into the base. These material handling features may include, for example, pop up rollers such as shown in FIG. 15. For heavy parts that have been formed and now rest in the cavity between the risers it is a benefit to have pop up rollers that lift up and aid with ejecting the part out the side of the press brake. Thus, for example, the pop up rollers (or other material handling device) shown in FIG. 15 may be incorporated into the adjustable die arrangement shown in FIGS. 3-9.

The concept described above eliminates the need for the mating teeth on the top face of the base and the bottom face of the risers (see, FIG. 10). The mating teeth features are vertically mounted on a side face of a locking member and a gear or locking rack as shown in FIGS. 8 and 9. Because these features being oriented in the vertical direction mill scale can no longer collect in the locking teeth. Mill scale is now not an issue for this concept and the urethane protective cover is no longer needed. As a result, the space between the risers to be used for material handling features such as pop up rollers, for example.

According to one embodiment disclosed herein a press brake is provided. The press brake includes a movable ram and a support beam, wherein the ram and the support beam are connected to a supporting frame. The support beam includes a base plate for supporting a die. The die includes a pair of movable upright members separated to form a punch receiving recess therebetween. The size of the recess may be adjusted by moving the upright members. The upright members are connected to the base plate by a locking member positioned in a cutout portion of the base plate. The locking member is configured to have horizontally projecting tooth shaped members running vertically that engage corresponding horizontally projecting tooth shaped members running vertically located on the base plate. The locking member moves horizontally to lock and unlock the upright members. When unlocked, the upright members may move to change the width of the punch receiving recess.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to any precise numerical ranges provided. Accordingly, these terms should be interpreted as indicating that insubstantial or inconsequential modifications or alterations of the subject matter described are considered to be within the scope of the invention.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "fore," "aft," "inboard," "outboard," etc.) are merely used to describe the orientation of various elements in the figures. It should be noted that the orientation of various elements may differ according to other exemplary embodiments, and that such variations are intended to be encompassed by the present disclosure.

It is important to note that the construction and arrangement of the press brake shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A press brake for bending a workpiece comprising:

a movable ram and a support beam, wherein the ram and the support beam are connected to a supporting frame;

a punch connected to the ram, and a die connected to the support beam;

wherein the punch and the die are separated by a gap and wherein the press brake is configured to receive the workpiece in the gap;

wherein the ram is configured to be driven towards the support beam to thereby close the gap between the punch and the die;

wherein the die includes a pair of die members extending in a longitudinal direction separated by a recess having a width in a lateral direction perpendicular to the longitudinal direction, wherein the longitudinal direction is perpendicular to the lateral direction and perpendicular to a direction of movement of the ram, and wherein the width of the recess is adjustable by moving the die members; and wherein the die members are releasably engaged with the support beam, and wherein the die members move horizontally in the longitudinal direction to disengage from the support beam to thereby allow for lateral movement of the die members to adjust the width of the recess.

2. The press brake of claim 1, wherein each die members includes one of a protrusion and depression that engages with the other one of a protrusion and depression located on the support beam.

3. The press brake of claim 2, wherein the press brake is configured so that mill scale resulting from the bending of the work piece falls directly onto the support beam.

4. The press brake of claim 2, wherein each of the die members includes a locking member that moves between a locked position and an unlocked position, and wherein in the locked position the locking members are engaged with the support beam and wherein in the unlocked position the locking members are disengaged with the support beam and free to move laterally.

5. The press brake of claim 4, wherein in the locked position the locking member interlocks with a corresponding locking rack located on the support beam.

6. The press brake of claim 2, wherein the support beam includes a base plate and wherein each of the die members include a riser and wherein a locking member is connected to the bottom of the riser and wherein the press brake is configured so that the locking member moves longitudinally with the riser between a locked position and an unlocked position.

7. The press brake of claim 4, wherein the support beam includes a locking rack having a vertically extending groove that forms the depression.

8. The press brake of claim 7, wherein in the locked position the locking member fits into the vertically extending groove in the locking rack.

9. The press brake of claim 7, wherein the locking member includes a vertically extending protrusion that fits into the vertically extending groove in the locking rack.

10. The press brake of claim 5, wherein the locking rack includes a vertically extending protrusion that fits into a vertically extending groove in the locking member.

11. The press brake of claim 4, wherein the support beam includes a base plate and wherein each of the die members include a riser and the locking member is connected to the bottom of the riser so that the locking member is located beneath the top of the base plate.

12. The press brake of claim 7, wherein the locking member is located in a groove in the support beam that is configured to allow for horizontal movement of the locking member.

13. An adjustable die for a press brake including a ram and a support beam, comprising:

a pair of movable die members extending in a longitudinal direction separated by a recess having a width in a lateral direction perpendicular to the longitudinal direction, wherein the width of the recess is adjustable by moving the die members;

wherein the die members are releasably engaged with the support beam, and wherein the die members move horizontally in the longitudinal direction to disengage from the support beam to thereby allow for lateral movement of the die members to adjust the width of the recess, wherein the horizontal and lateral movements are in perpendicular directions; and a movable locking member connected to the die members that moves to lock and unlock the die members from the support beam.

14. The adjustable die of claim 13, wherein locking member moves between a locked position and an unlocked position, and wherein in the locked position the die members are engaged with the support beam and wherein in the unlocked position the die members are disengaged with the support beam and free to move laterally.

15. The adjustable die of claim 14, wherein the locking member has a notched surface that engages a corresponding notched surface in the support beam and wherein when the die member moves from a locked position to an unlocked position the notched surface of the locking member and the notched surface of the support beam become disengaged.

16. The adjustable die of claim 15, wherein in the locked position the locking member fits into a vertically extending groove in the support beam.

17. The adjustable die of claim 15, wherein the locking member includes a vertically extending groove for receiving a vertically extending protrusion located on the support beam.

18. A press brake for bending a workpiece comprising:

a movable ram and a support beam, wherein the ram and the support beam are connected to a supporting frame;

a punch connected to the ram, and a longitudinally extending die connected to the support beam;

wherein the punch and the die are separated by a gap and wherein the press brake is configured to receive the workpiece in the gap;

wherein the ram is configured to be driven towards the support beam to thereby close the gap between the punch and the die;

wherein the die includes a pair of die members extending in a longitudinal direction and separated by a recess having a width in a lateral direction perpendicular to the longitudinal direction, wherein the width of the recess is adjustable by moving the die members; and a movable locking member connected to the die members and engaged with the support beam, wherein the locking member moves with the die members horizontally in the longitudinal direction from a locked position to an unlocked position to allow the width of the recess to be adjusted, and wherein the longitudinal direction is perpendicular to the lateral direction and perpendicular to a direction of movement of the ram when the ram is driven towards the punch.

19. The press brake of claim 18, wherein in the locked position the die members are engaged with the support beam and wherein in the unlocked position the die members are disengaged with the support beam and free to move laterally.

20. The press brake of claim 18, wherein the locking member includes a vertically extending protrusion for engaging a corresponding vertically extending groove located on the support beam.

* * * * *